United States Patent [19]

Kremer

[11] 4,019,488

[45] Apr. 26, 1977

[54] ROTARY VALVE ENGINE WITH LUBRICATOR

[76] Inventor: Alphonse E. Kremer, 1900 E. Beach Blvd., Gulfport, Miss. 39501

[22] Filed: Dec. 20, 1974

[21] Appl. No.: 534,868

Related U.S. Application Data

[63] Continuation-in-part of Ser. No. 398,789, Sept. 19, 1974, abandoned.

[52] U.S. Cl. ..... 123/190 BB; 123/190 BA; 123/190 BF

[51] Int. Cl.[2] ..... F01L 7/00

[58] Field of Search ..... 123/190 BA, 190 BF, 123/190 BE, 190 BB, 190 DB, 190 R, 190 C, 190 E

[56] References Cited

UNITED STATES PATENTS

| | | | |
|---|---|---|---|
| 717,417 | 12/1902 | Koken | 123/190 BB |
| 1,290,413 | 1/1919 | Treat | 123/190 BB |
| 1,465,142 | 8/1923 | McKelvy | 123/190 BB |
| 1,927,348 | 9/1933 | Morris | 123/190 BB |
| 1,971,060 | 8/1934 | Wells | 123/190 BB |
| 2,142,325 | 1/1939 | McLaren | 123/190 BB |

FOREIGN PATENTS OR APPLICATIONS

| | | | |
|---|---|---|---|
| 445,211 | 8/1912 | France | 123/190 BA |

*Primary Examiner*—Ronald H. Lazarus
*Attorney, Agent, or Firm*—Clarence A. O'Brien; Harvey B. Jacobson

[57] ABSTRACT

A rotary valve engine in which the rotary valve is located laterally of the cylinder and includes straight longitudinally extending, concentrically arranged intake and exhaust passages for unrestricted flow of air or combustible mixture into the cylinder or cylinders and exhaust of combustion products with the incoming air or combustible mixture being in heat exchange relation to the exhausting combustion products. The rotary valve includes an inner tubular exhaust member made in sections connected together with expansion joints, seal strips mounted in the bore of the valve case with the valve being suspended in the valve bore and the rotary valve being lubricated by a roller lubricating system.

8 Claims, 9 Drawing Figures

ROTARY VALVE ENGINE WITH LUBRICATOR

CROSS REFERENCE TO RELATED APPLICATION

This application is a continuation-in-part of my copending application Ser. No. 398,789, filed Sept. 19, 1974, now abandoned.

BACKGROUND OF THE INVENTION

1. Field of the Invention

The present invention generally relates to internal combustion engines and more particularly a rotary valve for admitting air or a mixture of air and fuel and discharging exhaust products including a rotary valve member incorporating concentrically arranged intake and exhaust passages isolated from each other and selectively communicated with the cylinder or cylinders of the engine with the valve member being rotatably driven in timed relation to reciprocation of the pistons for proper intake and exhaust.

2. Description of the Prior Art

In my prior U.S. Pat. No. 1,281,794, a rotary valve is disclosed in combination with a reciprocating engine in which the rotary valve is oriented above the cylinders and piston and includes a spiral divider or partition which introduced a spiral movement into the air and combustion products. Other prior U.S. patents disclosing rotary valve structures for internal combustion engines include U.S. Pat. Nos. 741,178, 1,112,523, 1,464,469, 1,713,318, 1,746,728, 1,890,953, 2,019,042, 2,109,608, 2,674,987, 2,730,088, 2,799,258, 2,975,774, 2,989,955 and 3,171,425.

SUMMARY OF THE INVENTION

The rotary valve concept for internal combustion engines has many advantages over the poppet and other type valve mechanisms. Among the advantages are volumetric efficiency due to larger port opening, silent operation, lower manufacturing cost.

However, there are a number of mechanical problems inherent to the rotary valve that heretofore have made them impractical, and to this date there are no successful rotary valve engines on the market, they all having the same problems to overcome including the applicant's original rotary valve patented in 1918, U.S. Pat. No. 1,281,794. The problems to be overcome on the rotary valve include uneven, expansion and distortion, wear, sealing and lubrication.

The object of this invention is to solve or overcome the above-mentioned problems and thus make the rotary valve concept practical.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
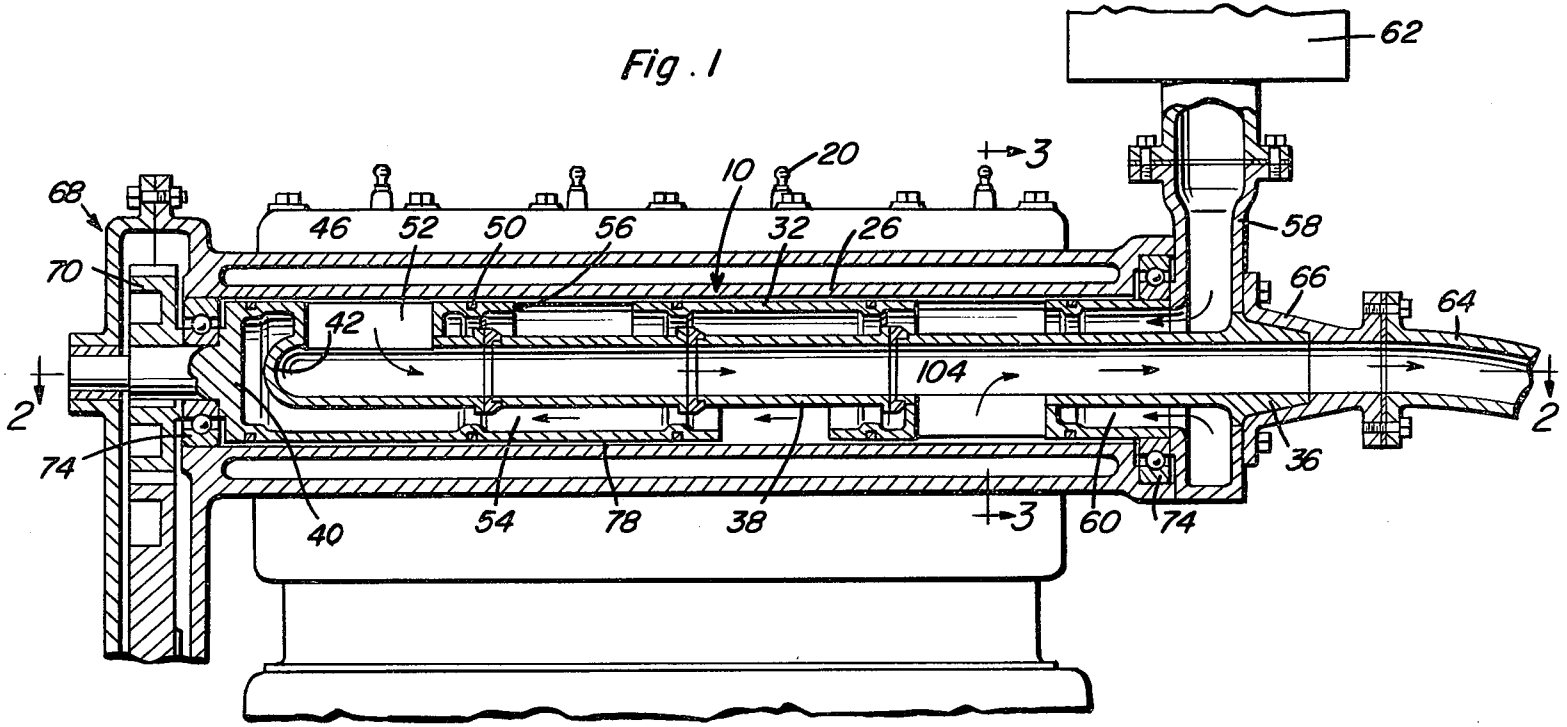
FIG. 1 is a longitudinal section of the rotary valve assembly illustrating the suspended valve in its case, supported or journaled by bearings on each end, and other structural details.
Figure 9:
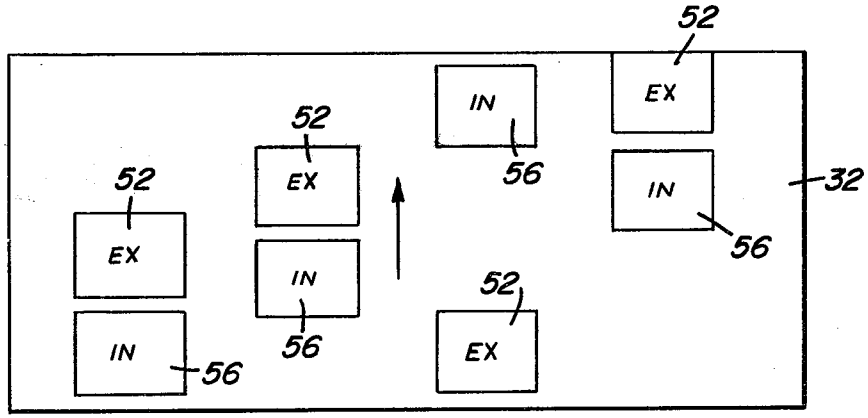
FIG. 9 is a schematic elevation of the ports in the valve laid out.

Referring to the drawings, the rotary valve assembly is designated by the numeral 10 and is associated with an internal combustion engine 12 having a bank of in-line cylinders 16 with reciprocating pistons 18 in the conventional and well known manner. The cylinders 16 are closed at the upper end forming the combustion chamber 14 and have a spark plug 20 for igniting the combustible mixture, or an injector nozzle should the engine be diesel. This combustion chamber 14 at the top of the cylinder 16 has a single passageway or port 24 for the entry of air or combustible mixture and the exit of combustion products, this passageway communicating laterally with an elongated hollow cylindrical sleeve or case 26 integral with the engine block which includes a jacket 28 defining a hollow space 30 for circulation of cooling fluid which circulates through the hollow areas or passageways in the engine block and cylinder head to maintain proper operating temperature.

The rotary valve assembly includes an outer cylindrical tubular member 32 which includes a projecting axle shaft 34 at one end. Disposed concentrically within the tubular member 32 is an inner tubular member 38 with the tubular member 32 being hereinafter referred to as the outer tubular member. The inner tubular member 38 is concentrically arranged with respect to the outer tubular member 32 and one end of the tubular member 38 terminates in spaced relation to an end wall 40 in the outer tubular member 32 with the shaft 34 being secured to the end wall 40. The closed end wall of the inner tubular member 38 is designated by numeral 42 and is rounded to permit circulation of exhaust products substantially throughout the periphery of the inner tubular member 38 except where passageways or openings 44 are provided in the periphery of the inner tubular member 38 which are in registry with inwardly extending flanges 46 on the tubular member 32 which define an exhaust passageway through the annular space between the outer surface of the inner tubular member 38 and the outer surface of the tubular member 32.

The external surface of the tubular member 32 is provided with a plurality of longitudinally spaced circumferential grooves 48 which receive seal rings 50 therein which are in engagement with the inner periphery of the sleeve 26 to isolate a segment of the tubular member with respect to each cylinder 16. Between each of the grooves 48 and seals 50, there is an exhaust passageway 52 defined by the aperture or opening 44 and the flanges 46 thus communicating the interior of the inner tubular member 38 with the upper end of cylinder 16 when the passageway 52 is aligned with the passageway 24. The flange 44 and its rigid connection with the inner tubular member 38 isolates the exhaust passageway 52 from the intake passageway 54 which is defined by the external surface of the inner tubular member 38 and the internal surface of the tubular member 32. The tubular member 32 is provided with an opening 56 between each pair of grooves 48 which communicates only with the space 54 and which align with the passageway 24 thus communicating the intake space 54 with the interior of the cylinder 16 when the openings 56 are aligned with the passageway 24. Thus, the valve assembly includes an inlet passageway 56 and an exhaust passageway 52 between adjacent grooves 48 with the number of passageways corresponding with the number of cylinders so that in proper sequence, each cylinder is supplied with a combustible mixture through the intake passageway 54 and a corresponding intake opening 56 and subsequently, the passageway 24 will be aligned with the corresponding exhaust passageway 52.

The end of the tubular member 32 remote from the end wall 40 is communicated with an intake manifold 58 through an annular passage 60. The intake manifold 58 is provided with a carburetor 62 or other suitable fuel and air proportioning and mixing device for supplying a combustible mixture to the intake manifold 58 which enters the passageway 54 through the annular space or opening 60. The inner tubular member 38 is communicated with an exhaust pipe 64 at the same end of the engine which has the carburetor 62 thereon with a suitable adapter 66 being provided for rotatably receiving the tapered hollow end 36 of the inner tubular member 38 as illustrated in FIG. 1 thereby providing a rotary seal for the inner tubular member 38 when it joins with the exhaust pipe 64 for proper exhaust of the products of combustion.

The shaft 34 on the opposite end of the tubular member 32 extends into a housing assembly 68 on the opposite end of the engine and is provided with a gear 70 thereon which is in meshing engagement with a drive gear 72 for rotatably driving the tubular member 32 and the inner tubular member 38 rigid therewith at a predetermined rotational speed in timed relation to reciprocation of the pistons 18.

The firing arrangement in the cylinders may be altered with this arrangement of components by altering the orientation of the ports in the rotary members 32 and 38 thereby enabling the firing order to be altered into any desired sequence.

Both the exhaust and intake are oriented at the same end of the valve. The location of the exhaust tube or inner tubular member 38 centrally and the particular orientation of the closed end thereof enables the exhaust products from the cylinder at the closed end to enter the exhaust passageway and then the exhaust from the next adjacent cylinder and then sequentially to the end of the bank of cylinders thus causing the valve tube 38 to get progressively hotter toward the outlet end. However, this is offset by the incoming cool intake gas from the intake manifold which completely surrounds the exhaust tube with the greatest volume of flow of cool gas being at the entrance and being progressively reduced until it reaches the most distant cylinder where the exhaust tube is the least hot. Thus, the greatest volume of cool gas will be at the hottest end of the valve and the least volume where the valve is coolest thus keeping the valve at an approximate even temperature throughout its length. This uniform temperature of the valve throughout its length will prevent distortion or warpage of the valve thereby permitting a close tolerance between the valve and casing and prevent seizing.

Also, the use of one port in each cylinder serving both exhaust and intake permits the largest possible port opening which may be approximately twice the area of the port opening in a valve mechanism that has two ports per cylinder thus allowing for maximum breathing and volumetric efficiency and this arrangement also allows or permits any suitable or desired firing order. The seal strips may be incorporated into the surface of the valve, or in the bore of the valve sleeve or housing. Additionally, the valve arrangements disclosed provide the least number of ports on both the valve and the cylinders, the largest possible port openings in both the valve and the cylinders, a simple design which is low in manufacturing cost, the least number of parts, uniform temperature of the valve thus preventing distortion, any optional firing order, fast port opening and closing, the largest possible breathing or volumetric efficiency due to the large port openings, for elimination of reciprocating parts and results in substantially silent mechanical operation.

Figure 6:
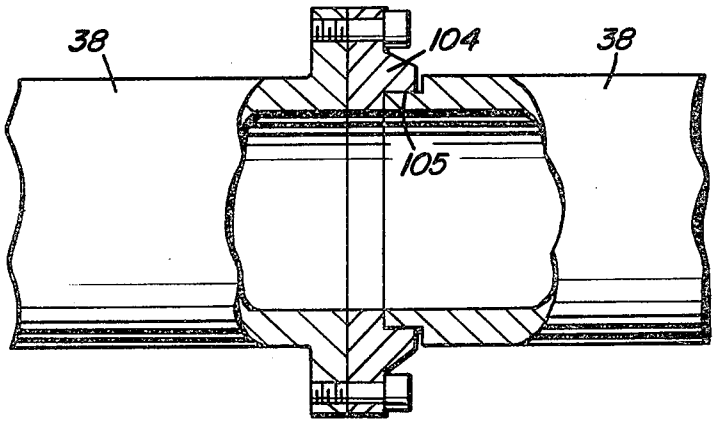
FIG. 6 is a cross section of the expansion joint in the exhaust tube.
Figure 5:
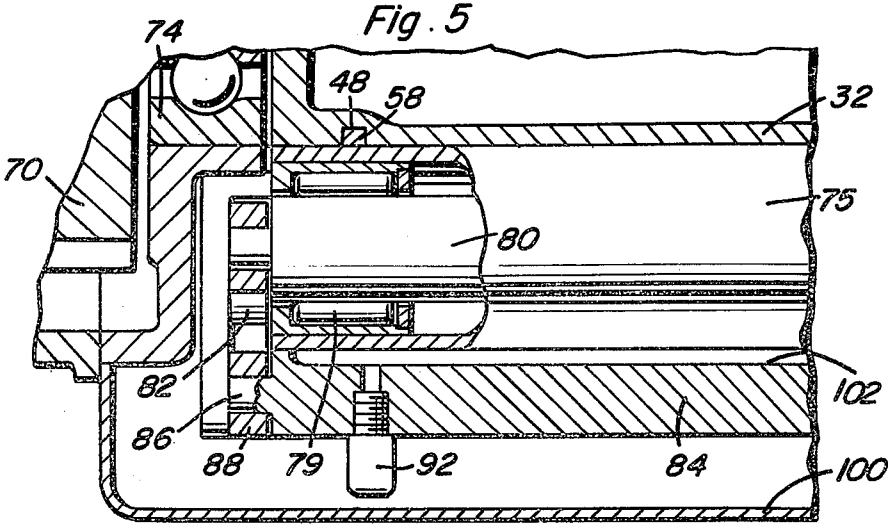
FIG. 5 is a fragmental sectional view of the oil roller and oil and wiper blade.
Figure 7:
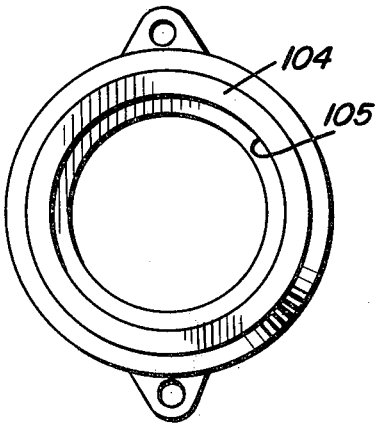
FIG. 7 is an end view of the expansion joint.

Another improvement on this rotary valve assembly is making the exhaust tube 38 in sections and joining the sections with expansion joints or connections, as illustrated in FIGS. 1, 6 and 7. The joint is simply a spacer collar 104 bolted to one section with the bolt holes slightly enlarged that permits the flat surface to slightly slide permitting transverse expansion and contraction. The other side of spacer has a slip fit bore 105 on the adjoining exhaust section permitting longitudinal expansion and contraction. This feature helps eliminate the distortion of the outer tube 32 due to the difference in expansion of the hot exhaust passage tube 38 and the cooler outer tube 32 to which the sections are bolted. The general arrangement of these joints or connections are illustrated in FIGS. 1, 6 and 7.

Figure 2:
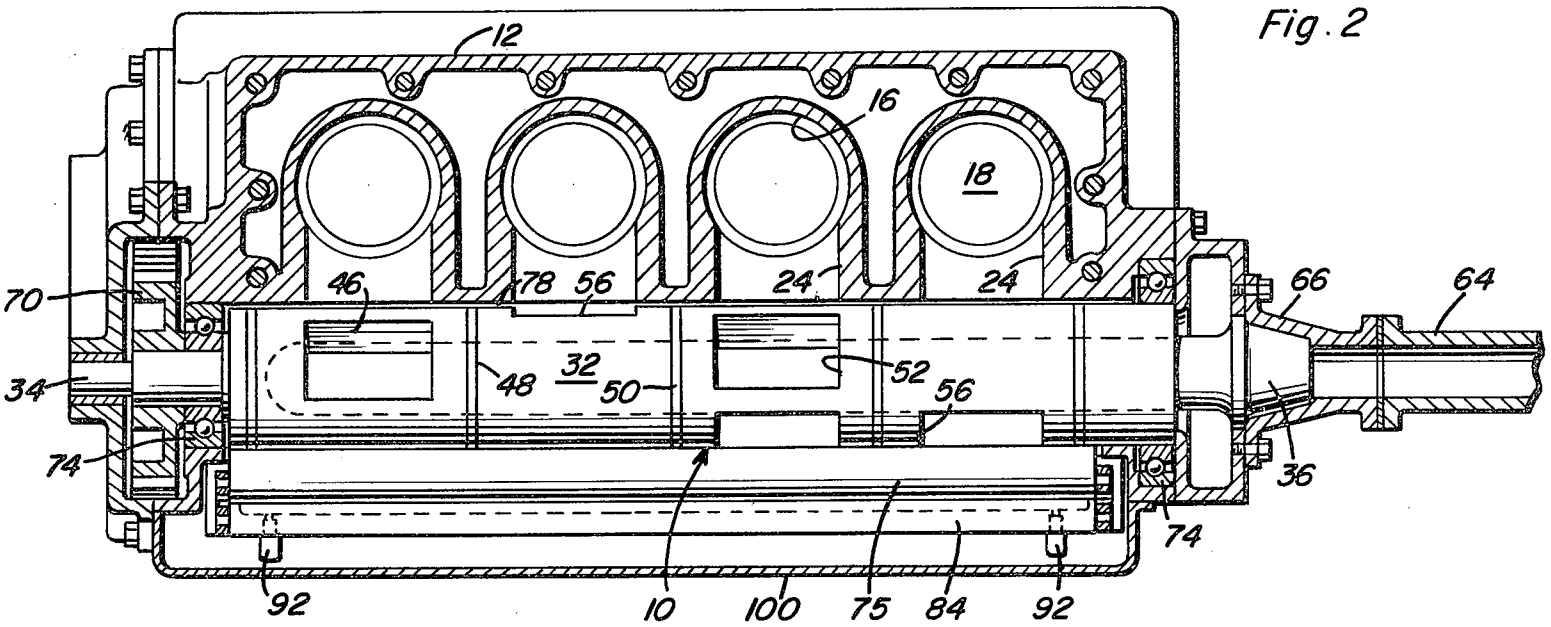
FIG. 2 is a plan sectional view illustrating the valve, the oil roller and oil and wiper blade and their association with the cylinder block.
Figure 3:
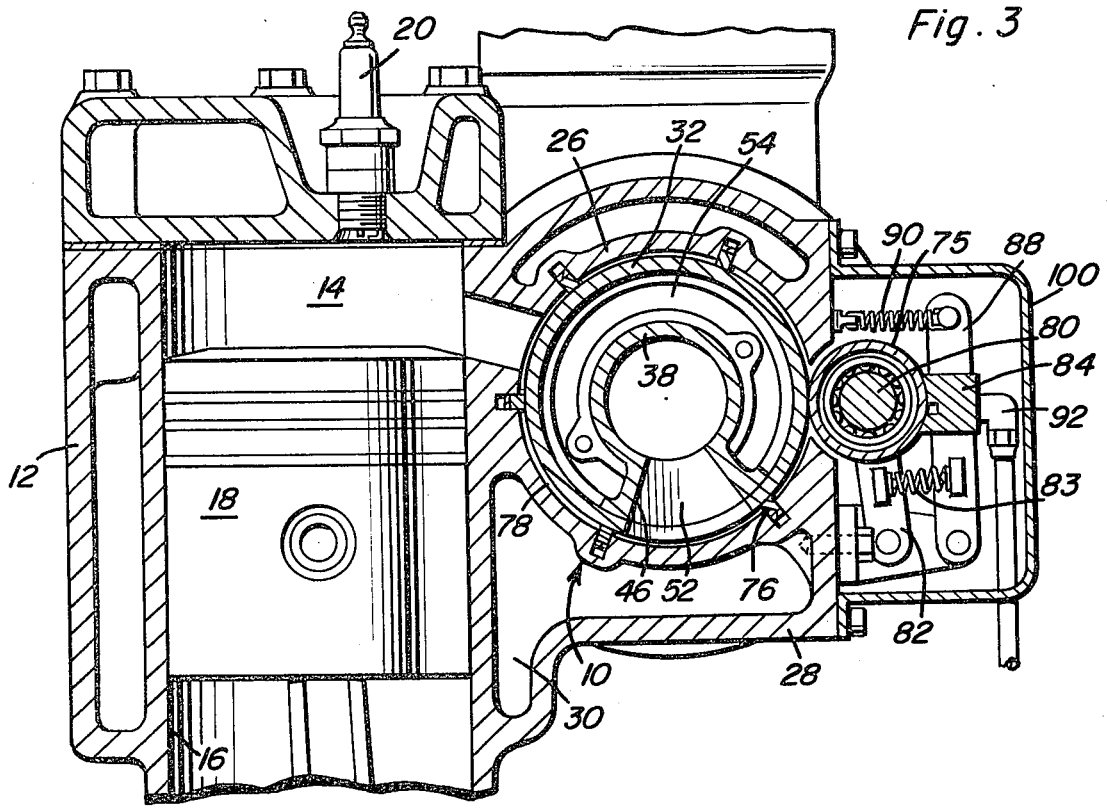
FIG. 3 is a transverse vertical section along section line 3—3 on FIG. 1 illustrating the valve in its case with the longitudinal seal strips mounted in the valve case and the lubricating roller and oil wiper blade in its association to the valve.
Figure 4:
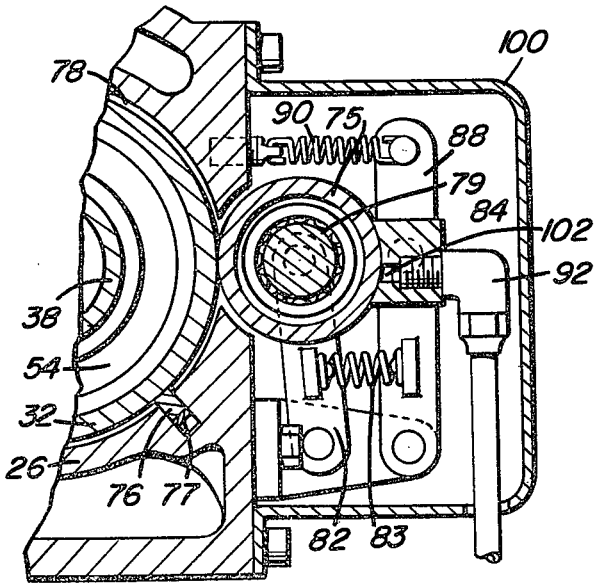
FIG. 4 is a transverse sectional view of the oil roller and oil and wiper blade assembly.

Another important improvement on the valve assembly is the floating or suspending of the valve 32 in the bore of the case 26 so that the face or outer surface of the valve does not come in contact with the bore of the case having a sufficient amount of clearance to take care of any expansion or distortion that may exist under different operating conditions. The valve is supported or journaled on large ball or roller bearings 74 on each end. These bearings with their comparative light load should outwear the engine several times. The space 78 between the valve and its case are blocked off by suitable sealing rings 50 which may be of split, resilient construction and longitudinal strips 76 which may be segmental and properly spaced between the rings 50 and between the cylinders and ports, the area between the valve surface and the valve bore covering the cylinder port during compression and power strokes becomes part of the combustion chamber. This important floating feature eliminates the possibility of the valve seizing under any condition, and eliminates wear. This arrangement is shown in the drawings, FIG. 1 showing the supporting bearings and FIGS. 2 and 3 showing the space between the valve and its case.

Figure 8:
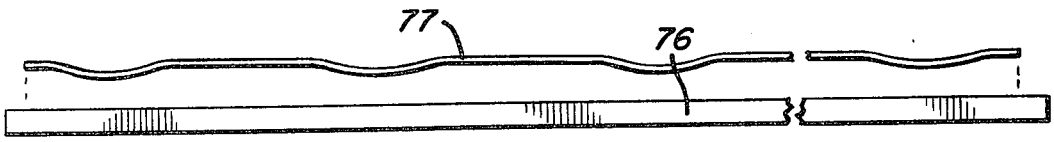
FIG. 8 is a side elevational view of the longitudinal sealing strip and spring therefor.

Another feature in this rotary valve assembly that is important is the mounting of the seal strips 76 and a spring 77 in the form of a light leaf spring having undulations therein in the stationary case instead of the rotating valve as shown in FIG. 8. This is for the purpose of eliminating the excessive wear due to centrifugal force on the valve strips if mounted in the rotating valve. It is stated that a seal strip and spring weighing one ounce turning on a radius of 2 inches at 5000 rpm exerts an outward pressure of 85 pounds. Seal strips in the case being stationary have only a light spring pressure therefore having a minimum amount of wear.

This rotary valve assembly has another very desirable improvement and that is in the lubrication system. Lubrication has always been a problem on rotary valve engines. Various gravity feed and pressure systems have been tried. Gravity feed does not give sufficient oil at high speed, the pressure system feeds too much oil at low speed the oil going into the intake ports which are pulling a vacuum thus fouling the plugs, etc. My concept of the roller feed that supplies only a thin film of oil on the valve surface at all speeds solves the problem. This is the same principle used on modern printing presses that have a wiped ink roller that supplies just the right amount of ink on the type to print clearly and not blur. This lubricating arrangement is shown in FIGS. 2–5, and how the assembly is mounted or incorporated in the engine in FIG. 3. Referring to the drawings, the roller lubricating system consists of a hollow roller 75 the approximate length of the valve 32 and is trunnioned on two bearings 79 on the inside stationary shaft 80 that extends through the roller and is supported at each end on hinges or pivot links 82. The valve case 28 has an aperture or slot the length of the roller just wide enough for the oil roller 75 to come in contact with the rotary valve 32, said roller 75 being held firmly against the valve by spring pressure exerted by spring 83 in order that when the valve turns it will drive or turn oil roller by friction. Associated with the roller 75 there is a combination oil and wiper blade 84 the length of the roller and it is supported by a trunnion 86 on each end that pivots on hinges or pivot links 88. Trunnion 86 is a free fit in order that the blade will align itself with the roller and the blade is held firmly against the roller by springs 90. The oil wiper blade 84 has an oil slot or groove 102 on the side contacting the roller 75 extending from near one end to near the other end and is connected with oil tube fittings 92 on each end. The oil roller assembly is encased in an oil pan or cover 100 for protection and oil drippage. The oil roller assembly is mounted on the engine block as shown in FIG. 3. The roller oil system functions as follows: Oil from the engine's regular oil system enters the fitting 92 on one end of the wiper blade 84, runs along the oil groove 102 to the opposite end of blade to the outlet fitting and returns to the oil pan and pump. The wiper blade 84 keeps the oil roller 75 supplied with a thin film of oil and the spring pressure on the blade keeps the surplus oil wiped off. The roller 75 with its thin film of oil rolling against the rotary valve 32 under spring pressure in turn keeps the entire valve surface coated with a thin film of oil which in turn lubricates the sealing rings and strips. The oil supplied on the valve under no pressure will not enter the ports and with centrifugal force also keeping the oil out we thus have a system that does not supply too much oil which would cause fouled plugs, smoking, etc. and as the system operates in timed relation to the speed of the engine a proportionate amount of oil is supplied for all speeds.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In an internal combustion engine having one or more cylinders, each cylinder having one port in the combustion chamber for the admission of air or combustible mixture and the discharge of combustion products, said engine having a rotary valve mechanism with a stationary sleeve communicating with the ports, a rotary member disposed in said sleeve and being rotatably driven, said rotary member comprising concentrically arranged and spaced inner and outer tubular members with the inner tubular member defining an exhaust passage and the annular space between the inner and outer tubular members defining an intake passage, said outer tubular member including an intake port for alignment with the port in communication with the combustion chamber, said inner tubular member including a radially extended passageway extending to the periphery of the outer tubular member is isolated relation to the annular space for communication with the port in the combustion chamber for selectively admitting air or a combustible mixture into the combustion chamber and discharging exhaust products therefrom through the port in the combustion chamber, said inner tubular member defining the exhaust passage and the annular space defining the intake passage being substantially straight throughout the length thereof, said inner tubular exhaust member being made in sections connected together with expansion joints, said outer tubular member being constructed of unitary construction, said expansion joints enabling transverse and longitudinal expansion of the inner tubular member thereby eliminating distortion of the outer tubular member due to differences in expansion and contraction.

2. The structure as defined in claim 1 wherein said outer tubular member includes longitudinally spaced, peripherally extending seal means disposed between adjacent pairs of inlet and exhaust ports therein.

3. The structure as defined in claim 2 wherein the engine includes a plurality of combustion chambers each of which is in the form of a cylinder having a reciprocating piston therein, said port extending laterally of the combustion chamber, said rotary valve assembly extending longitudinally alongside of the cylinders with the rotary member including duplicate intake and exhaust ports communicating with the intake passage and exhaust passage respectively with the single port in the combustion chamber enabling the firing order of the engine to be varied.

4. The structure as defined in claim 3 wherein said rotary member includes gear drive means associated with one end thereof, said inner tubular member being in axial communication with an exhaust pipe at one end thereof, said outer tubular member being in axial communication with an intake manifold at the same end thereof.

5. The structure as defined in claim 4 together with longitudinal seal strips sealing the space between the valve and sleeve, said seal strips being mounted in the stationary sleeve in which said rotary member rotates.

6. The structure as defined in claim 5 wherein the other end of the inner tubular member is closed and spaced from the adjacent end of the outer tubular member to enable circulation of intake air over substantially the entire external surface of the inner tubular member for heat transfer between counterflowing exhaust and intake gases.

7. The structure as defined in claim 6 having the rotary member floating or suspended in the sleeve, supported on each end by bearings, and having sufficient clearance or space between the outer surface and the inner surface of the sleeve so as not to come in contact with each other under any heat or expansion condition.

8. The structure as defined in claim 1 wherein said sleeve includes a roller rotatably supported in peripheral contact with the outer tubular member for simultaneous rotation therewith, a lubricating oil supplying blade assembly contacting the roller throughout its length and transferring a substantially constant but thin film of oil to the roller which transfers a thin coating of oil to the outer tubular member during rotation.

* * * * *

UNITED STATES PATENT OFFICE
CERTIFICATE OF CORRECTION

PATENT NO. : 4,019,488

DATED : April 26, 1977

INVENTOR(S) : ALPHONSE E. KREMER

It is certified that error appears in the above-identified patent and that said Letters Patent are hereby corrected as shown below:

Page 1, column 1, lines 8 and 9, change to read:

--Continuation-in-part of Ser. No. 398,789, Sept. 19, 1973, abandoned.--

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*